US010280599B2

(12) United States Patent
Peteri

(10) Patent No.: US 10,280,599 B2
(45) Date of Patent: May 7, 2019

(54) TAP AND AN ASSEMBLY COMPRISING A BOILING WATER DEVICE AND SUCH A TAP

(71) Applicant: HENRI PETERI BEHEER B.V., AJ Ridderkerk (NL)

(72) Inventor: Niels Theodoor Peteri, AJ Ridderkerk (NL)

(73) Assignee: HENRI PETERI BEHEER B.V., Ridderkerk (NL)

( * ) Notice: Subject to any disclaimer, the term of this patent is extended or adjusted under 35 U.S.C. 154(b) by 0 days.

(21) Appl. No.: 14/396,724

(22) PCT Filed: Apr. 23, 2013

(86) PCT No.: PCT/NL2013/050301
§ 371 (c)(1),
(2) Date: Oct. 23, 2014

(87) PCT Pub. No.: WO2013/162359
PCT Pub. Date: Oct. 31, 2013

(65) Prior Publication Data

US 2015/0076252 A1 Mar. 19, 2015

(30) Foreign Application Priority Data

Apr. 24, 2012 (NL) ..... 2008697

(51) Int. Cl.
*E03C 1/084* (2006.01)
*E03C 1/044* (2006.01)
*E03C 1/04* (2006.01)

(52) U.S. Cl.
CPC ..... *E03C 1/084* (2013.01); *E03C 1/041* (2013.01); *E03C 1/044* (2013.01); *E03C 1/0404* (2013.01); *E03C 1/0411* (2013.01)

(58) Field of Classification Search
CPC ..... E03C 1/084; E03C 1/041; E03C 1/0404; E03C 1/0411; E03C 1/044; E03C 1/08
See application file for complete search history.

(56) References Cited

U.S. PATENT DOCUMENTS 4,365,755 A * 12/1982 Aghnides ..... E03C 1/084 239/428.5
5,411,241 A * 5/1995 Nilsson ..... F16K 31/02 251/129.06

(Continued)

FOREIGN PATENT DOCUMENTS

CN 202032131 U 11/2011
FR 1 438 348 A 5/1966

(Continued)

*Primary Examiner* — Michael R Reid
*Assistant Examiner* — Patrick C Williams
(74) *Attorney, Agent, or Firm* — Knobbe, Martens, Olson & Bear, LLP

(57) ABSTRACT

Tap provided with a tap outflow having a first channel and a second channel and a jet aerator having a jet aerator housing which forms a downstream end of the tap outflow. The jet aerator is further provided with a jet breaker having a jet breaker wall with liquid passage openings, at least one wire mesh layer which is included downstream of the jet breaker wall in the jet aerator housing, an aeration chamber which is situated between the jet breaker and the at least one wire mesh layer, and an air supply of which an entrance opens into the environment and of which an exit opens into the aeration chamber. The tap outflow is further provided with a coupling assembly which is situated upstream of the jet breaker wall in the jet aerator housing and which forms a liquid-tight connection between the first conduit and the jet breaker wall, such that liquid from the first channel is kept separate from liquid from the second channel upstream of the jet breaker wall.

2 Claims, 3 Drawing Sheets

(56) References Cited

U.S. PATENT DOCUMENTS

| | | | | |
|---|---|---|---|---|
| 2003/0141384 | A1* | 7/2003 | Grether | E03C 1/086<br>239/428.5 |
| 2007/0152082 | A1* | 7/2007 | Hyslop | E03C 1/0404<br>239/428 |

FOREIGN PATENT DOCUMENTS

| | | | |
|---|---|---|---|
| GB | 2104 625 | A | 3/1983 |
| GB | 2104625 | A | 3/1983 |
| JP | 3-103365 | U | 10/1991 |
| JP | 9-3990 | A | 1/1997 |
| JP | 2002-54196 | A | 2/2002 |
| JP | 2006-225982 | A | 8/2006 |
| JP | 2008-297862 | A | 12/2008 |
| NL | 2 003 205 | C | 1/2011 |

* cited by examiner

TAP AND AN ASSEMBLY COMPRISING A BOILING WATER DEVICE AND SUCH A TAP

CROSS-REFERENCE TO RELATED APPLICATIONS

This application is the U.S. National Phase under 35 U.S.C. § 371 of International Application PCT/NL/2013050301, filed Apr. 23, 2013, which claims priority to NL 2008697 filed Apr. 24, 2012.

FIELD

The invention relates to a tap with the aid of which two kinds of liquid can be tapped, more particularly a tap with which boiling water can be tapped as well as cold water and/or mixed water. Mixed water is to be understood to mean water having a temperature that is between the temperature of mains water and 70° C. Boiling water is to be understood to mean water having a temperature of more than 95° C. This as a result of the fact that the boiling water comes from a boiling water device having a boiler tank in which the water is held at a temperature of more than 100° C. under superatmospheric pressure.

BACKGROUND

Such a tap is known from NL2003205. The known tap is provided with a tap outflow having a first channel and a second channel, the tap outflow being provided with:

- a first conduit which bounds the first channel;
- a second conduit which bounds the second channel; and
- a jet aerator provided with a jet aerator housing which forms a downstream end of the tap outflow.

With the known tap, both boiling and mixed water can be tapped, via two separate channels within one tap outflow. The known tap outflow is provided with two concentric channels: a central channel that is bounded by an inner wall and which in the known tap serves for passing through boiling water. The outflow is further provided with an outer wall which, together with the inner wall, bounds a ring channel which serves for passing through mixed water. In the known tap the outer wall also forms the outer casing of the tap outflow. The jet aerator makes the jet of water from the central channel or the ring channel 'softer' and more regular. This is desired for drawing off both kinds of water. It is preferred to use one jet aerator for both streams, not only because such a configuration is simpler to realize but also because it is visually desirable for the tapped water to flow out of the outflow mouth with a full jet.

DE102008006255A1 shows a similar tap, where, however, the channels are not concentric. In a variant, it is proposed in that publication to keep the two water channels separate by passing one channel through the jet aerator. Water coming from that channel is therefore not aerated and made "soft" by a jet aerator. A similar construction whereby one channel is aerated and the other channel is not, is known from an exemplary embodiment described in GB 2 104 625.

A jet aerator is known per se and breaks up the massive liquid jet in a tap outflow into a large number of very thin jets in that the pipe pressure presses the water through a 'jet breaker' which forms the top of the jet aerator housing. The jet breaker is provided with a jet breaker wall comprising one or more layers of material which are provided with liquid passage openings, for example in the form of meshes or orifices. This jet breaker wall not only breaks up the water mass into small jets but also provides for acceleration of the water in that the effective cross section of liquid passage openings is significantly smaller than the pipe cross section. In the known jet aerators, below the jet breaker is an aeration chamber. The aeration chamber is in communication with the environment via the air supplies having an entrance that opens into the environment and an exit that opens into the aeration chamber. The air supplies may be designed, for example, as slots provided circumferentially in the jet aerator housing. The accelerated thin water jets which have been formed by the jet breaker create in the aeration chamber a reduced pressure (venturi effect) as a result of which ambient air is drawn in via the air supplies. Thereupon this air is entrained and mixed with the thin water jets in the aeration chamber.

The bottom part of the jet aerator is formed by a series of wire meshes or similar mats. The aerated jets are here aligned and proceed to egress in a more regular and calmer pattern.

SUMMARY OF THE INVENTION

The insight underlying the invention is that problems occur in the use of a jet aerator known per se in a tap having a tap outflow which is provided with two channels for dispensing two different kinds of liquids that are generally not tapped simultaneously, for example, on the one hand mixed water having a temperature of less than 70° C. and, on the other hand, boiling water.

In the use of a conventional jet aerator for the bifunctional tap, both channels open into a space above the jet breaker. The consequence of this is that during the alternate tapping from the two conduits, the two kinds of water are each 'pushed up' into the respective other channel via the space mentioned as a result of the resistance of the jet breaker. Two problems can then occur:

Problem 1: Boiling Water Penetrates into the Mixed Channel during Tapping.

Due to pressure increase in the space above the jet breaker, combined with the lower density of the superheated (>100° C.) water, this water can penetrate into the mixed water channel and there displace the heavier cold water. Also, it has been found that a small amount of air may thereby be enclosed in the mixed channel.

The consequences are:

- The tap outflow becomes warm and in some cases even burning hot
- In tapping mixed water after boiling water has been tapped, an annoying 'sputter' effect may occur upon release of the air bubbles from the mixed channel.

Problem 2: Mixed Water Penetrates into the Boiling Water Channel during Tapping.

The mixed water also penetrates into the other channel during tapping. This phenomenon even occurs more strongly in that after tapping of boiling water, the boiling water conduit is largely emptied through boiling action. Accordingly, after tapping, the boiling water conduit is filled with air for a good part. During tapping of mixed water, the mixed water will readily enter the boiling water conduit as a result of the back pressure induced by the jet breaker.

The consequences are:

- After tapping of mixed water there may be some afterflow of the water pushed up into the boiling water channel.
- Possibly, a part of the pushed-up water during the tapping of mixed water will, beyond the highest point of the outflow, flow down into the boiling water channel and remain stagnant above the shutoff valve. When this happens, the result is a cold initial flow upon tapping of boiling water. Cold initial flow is highly unwanted because often only small amounts of boiling water are tapped and the cold initial flow then has a relatively great influence on the temperature of the tapped amount of water.

The invention contemplates to provide a tap with which the above-described problems are resolved. To this end, the invention provides a tap according to claim 1. This is to say, a tap provided with a tap outflow having a first channel and a second channel, wherein the tap outflow comprises:

a first conduit which bounds the first channel;

a second conduit which bounds the second channel; and a jet aerator provided with:

a jet aerator housing which forms a downstream end of the tap outflow;

a jet breaker with a jet breaker wall having liquid passage openings, which jet breaker is included in the jet aerator housing, wherein a first part of the jet breaker wall bounds an outlet of the first conduit and a second part of the jet breaker wall bounds an outlet of the second conduit, wherein the first part is provided with first liquid passage openings which form a passage for liquid from the first channel, and wherein the second part is provided with second liquid passage openings which form a passage for liquid from the second channel;

at least one wire mesh layer which is included downstream of the jet breaker wall in the jet aerator housing and through which, in use, both liquid coming from the first channel and liquid coming from the second channel passes;

an aeration chamber which is situated between the jet breaker and the at least one wire mesh layer, wherein both the first and the second liquid passage openings open into the aeration chamber;

an air supply of which an entrance opens into the environment and of which an exit opens into the aeration chamber;

wherein the tap outflow further comprises:

a coupling assembly which is situated upstream of the jet breaker wall and comprises a coupling part having therein an internal channel and which forms a liquid-tight connection between the first conduit and the jet breaker wall, wherein the coupling assembly is configured such that liquid from the first channel in use is guided exclusively via the internal channel in the coupling assembly to the first part of the jet breaker wall and thereupon is only dispensed via the first liquid passage openings, and such that liquid from the second channel is guided exclusively to the second part of the jet breaker wall and thereupon is only dispensed via the second liquid passage openings.

The problems have been solved by keeping the two channels separate until after the jet breaker. Accordingly, the two kinds of liquid are kept separate from each other upstream of the jet breaker wall. This has been effected by arranging for the conduits that bound the channels to be liquid-tightly connected to the jet breaker wall. As a result, water being pushed up from the first channel into the second channel and vice versa is prevented and the annoying consequences do not occur anymore. The liquid passage openings in the at least one jet breaker wall form a liquid resistance that prevents reflux into the other channel.

In an embodiment, the first conduit can be a central conduit and the second conduit can substantially coaxially surround the central conduit, wherein the first channel has a substantially circular cross section and wherein the second channel has a substantially annular cross section, wherein the first part of the jet breaker wall is a central part and wherein the second part of the jet breaker wall is an annular part of the jet breaker wall which surrounds the central part of the jet breaker wall.

Such an embodiment has the advantage that the jet aerator housing can be attached to the tap outflow with the aid of a rotary connection. Such a rotary connection can comprise, for example, a screw thread connection or a bayonet connection. A detachable connection between the jet aerator and the tap outflow is advantageous because it allows simple cleaning of the jet aerator. Cleaning is desired, for instance, to remove lime and small solid particles.

In an embodiment the coupling assembly can comprise:

a coupling part which is provided with a nipple with which a downstream end of the first conduit is connected;

a cylindrical wall which forms an integral part of the jet breaker and which extends upwards from the jet breaker wall;

an O-ring which is accommodated in a groove of the coupling part and which provides a liquid-tight closure between the cylindrical wall and the coupling part.

In such an embodiment, when connecting the jet aerator housing with the outer casing of the tap outflow, which can also form the outer casing of the second conduit, automatically a water-tight connection between the first conduit and the cylindrical wall which forms an integral part of the jet breaker is effected. Thus it is accomplished that with the simple tightening of the jet aerator on the tap outflow, two watertight connections are created. Possibly, between the jet aerator housing and the second conduit a sealing ring may be placed which, upon tightening of the jet aerator housing on the second conduit, forms a sealing closure. The cylindrical wall of the jet breaker is thereby slid over the O-ring in a sealing manner. By virtue of this O-ring sealing, the entire jet aerator is removable.

An advantage of the combination of these two sealings is that there are no critical tolerances with respect to the mounting of the jet aerator to the tap outflow: the sealing of the O-ring is not critical with respect to small variations in the vertical position of the jet aerator relative to the second conduit of the tap outflow.

The invention further provides an assembly comprising:

a tap according to the invention;

a boiling water device provided with:

a boiler tank with a boiling water outlet which is in fluid communication with the interior of the boiler tank, a first boiling water conduit which forms part of a fluid communication between the boiling water outlet and a one of the first and the second channel;

a first cold water conduit which is in fluid communication with an other one of the first and the second channel.

Such an assembly provides the possibility of dispensing both cold water and boiling water having a temperature of more than 95° C. Both kinds of water are then dispensed via the same tap outflow and the same jet aerator. This saves a tap on the counter.

According to a further elaboration, the mixing tap assembly may be included in the above-mentioned fluid communication between the cold water conduit and the other one of the first and the second channel, wherein the first cold water conduit is connected to the cold water inlet of the mixing tap assembly, wherein the assembly further includes:

a mixing valve which is arranged between the tap and the boiler tank, wherein the mixing valve is provided with:

a cold water inlet which is connected to a second cold water conduit;

a boiling water inlet which is connected to a second boiling water conduit; and a hot water outlet for hot water having a temperature of less than 70° C.;

wherein the hot water outlet is in fluid communication via a hot water conduit with the hot water inlet of the mixing tap assembly, and wherein the mixed water outlet is connected to the other one of the first and the second channel.

In such an embodiment of the assembly, instead of dispensing exclusively boiling water and cold water, the tap outflow can also dispense mixed water having a temperature which is in the range of from mains water temperature to about 70° C. Accordingly, with a single tap on the counter, all the kinds of water that are desired in use in the kitchen can be dispensed. Moreover, with a relatively small boiler tank a large amount of mixed water can be produced. This as a result of the fact that the supply of water in the boiler tank has a temperature of more than 100° C. and therefore has to be mixed with a fairly large amount of cold water to obtain mixed water of an acceptable temperature. Such a relatively small boiler tank saves space in the sink cupboard.

In an alternative mode of the assembly with a tap according to claim 7, the hot water inlet of the mixing tap assembly may also be connected, instead of to a mixing valve with a fixed mixing ratio, to a second hot water source, for example, a boiler with a boiler tank in which hot water having a temperature of about 70° C. is stored.

DETAILED DESCRIPTION

Figure 1:
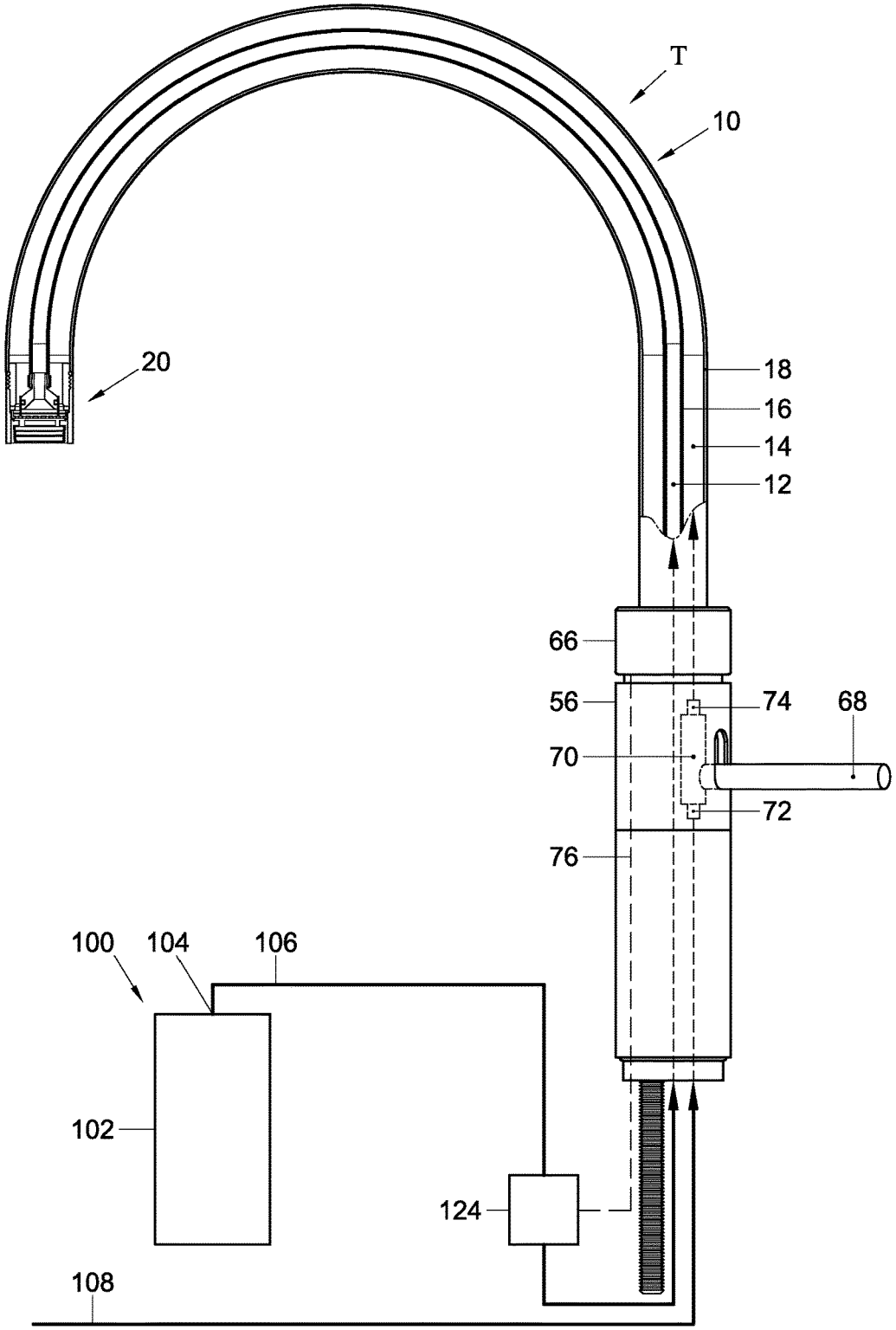
FIG. 1 shows a side view partly in cross section of an example of an embodiment of the tap in combination with a schematically represented boiling water device.
Figure 2:
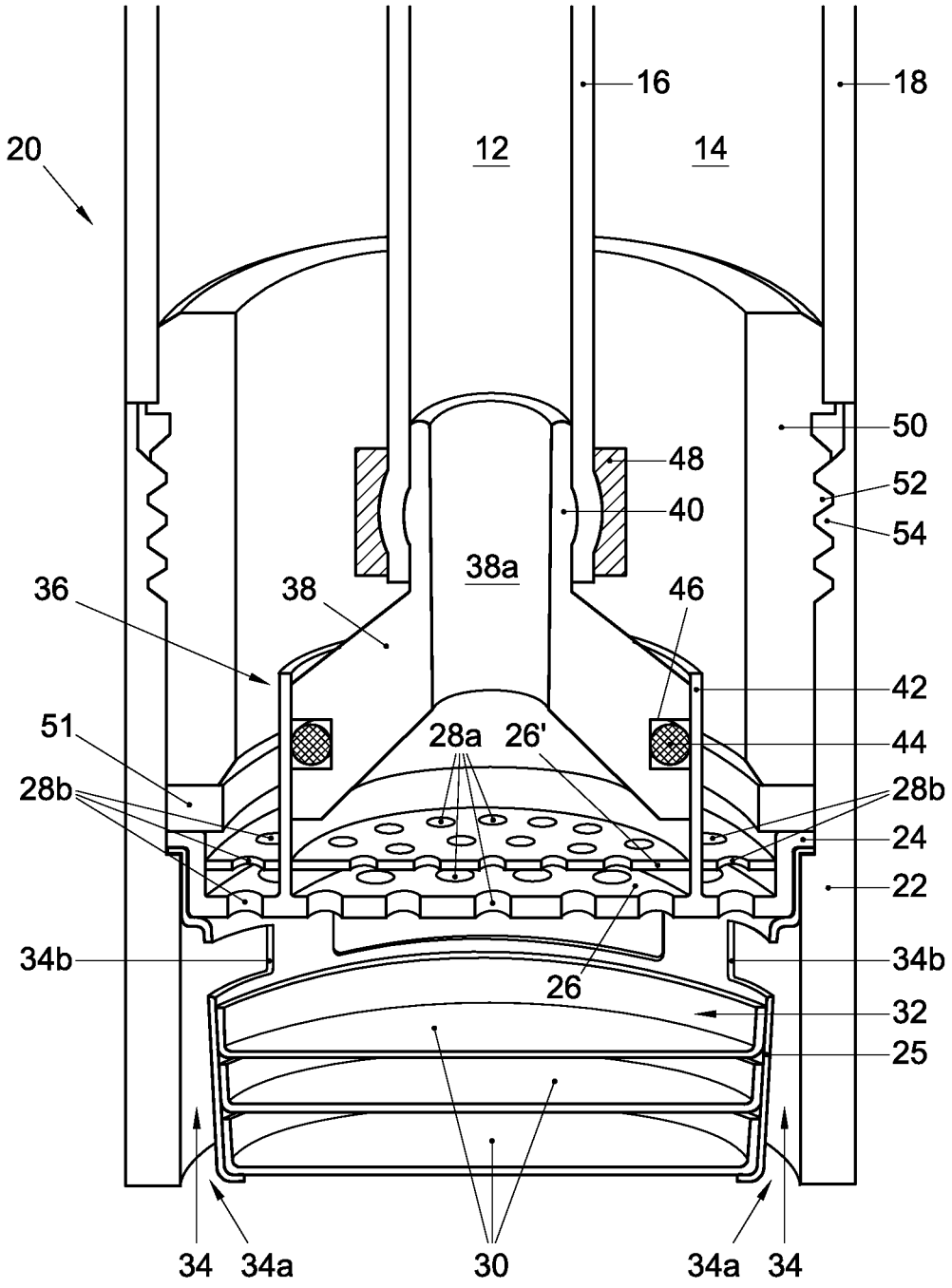
FIG. 2 shows a perspective cross-sectional view of the downstream end of the tap outflow with jet aerator of the example shown in FIG. 1.

FIG. 1 shows an example of an embodiment of an assembly of a boiling water device 100 and an example of a tap T. FIG. 2 shows an example of the downstream end of a tap outflow 10 of the tap T represented in FIG. 1, in which different embodiments of the invention are embodied. The tap T is provided with a tap outflow 10 having a first channel 12 and a second channel 14. The tap outflow 10 is provided with a first conduit 16 which bounds the first channel 12, a second conduit 18 which bounds the second channel 14, and a jet aerator 20. The jet aerator 20 is provided with a jet aerator housing 22 which forms a downstream end of tap outflow 10. The jet aerator 20 is further provided with a jet breaker 24 with a jet breaker wall 26 having liquid passage openings 28*a*, 28*b*. In the example shown in FIG. 2, the jet breaker 24 is provided with two parallel jet breaker walls 26, 26'. However, a jet breaker 24 with a single breaker wall 26 or with more than two parallel jet breaker walls 26 is also a possibility. The jet breaker 24 is included in the jet aerator housing 22. Downstream of the jet breaker wall 26 at least one wire mesh layer 30 is included in the jet aerator housing 22. Between the jet breaker 24 and the at least one wire mesh layer 30 is an aeration chamber 32. The jet aerator 20 is provided with at least one air supply 34 of which an entrance 34*a* opens into the environment and of which an exit 34*b* opens into the aeration chamber 32. The tap outflow 10 is further provided with a coupling assembly 36 which is situated upstream of the jet breaker wall 26 and which forms a liquid-tight connection between the first conduit 16 and the jet breaker wall 26. As a result of this liquid-tight connection, liquid from the first channel 12 can in use be guided exclusively via an internal channel 38*a* in the coupling assembly 36 to a first part of the jet breaker wall 26, and this liquid from the first channel 12 is only dispensed via liquid passage openings 28*a* which are in the first part of the jet breaker wall 26. The coupling assembly 36 also provides that liquid from the second channel 14 is guided exclusively to a second part of the jet breaker wall 26 and that in use this liquid from the second channel 14 is only dispensed via liquid passage openings 28*b* which are in the second part of the jet breaker wall 26.

In the example of FIG. 2, the jet aerator 20 comprises a sub-housing 25 in which the wire mesh layers 30 and the jet breaker 24 are included. The sub-housing 25 further includes the exits 34*b* of the air supply 34. The sub-housing 25 itself in turn is included in the jet aerator housing 22. In an alternative mode, however, it is also possible that the wire mesh layers 30 and the jet breaker 24 are included directly in the jet aerator housing 22. To that end, the jet aerator housing 22 may be provided with internal, circumferential profiled edges which form a kind of steps on which rest the wire mesh layers 30 and the jet breaker 24.

In an embodiment, of which an example is shown in the Figures, the first conduit 16 can be a central conduit and the second conduit 18 can surround the central conduit 16 substantially coaxially. The first channel 12 preferably has a substantially circular cross section. The second channel 14 preferably has a substantially annular cross section. In that embodiment the first part of the jet breaker wall 26 is formed by a central part thereof. The second part of the jet breaker wall 26 is formed by an annular part of the jet breaker wall 26 which surrounds the central part of the jet breaker wall 26.

Clearly, in an alternative embodiment the two conduits 12, 14 do not have to be, of coaxial design. However, the coaxial design has the advantage of enabling a detachable connection by means of rotation between the jet aerator 20 and the tap outflow 10. Such a connection can be formed, for instance, by a screw thread connection or a bayonet connection.

In further elaboration of this embodiment, of which an example is shown in FIG. 2, the coupling assembly 36 may comprise a coupling part 38 which is provided with a nipple 40 with which a downstream end of the first conduit 16 is connected. The coupling assembly 36 can further comprise a cylindrical wall 42 which forms an integral part of the jet breaker 24 and which extends upwardly from the jet breaker wall 26. In that further elaboration, the coupling assembly 36 further comprises an O-ring 44 which is accommodated in a groove 46 of the coupling part 38 and which provides a liquid-tight closure between the cylindrical wall 42 and the coupling part 38. Owing to the O-ring 44 sealing against the cylindrical wall 42 of the jet breaker 24, the jet breaker 24 can take different axial positions relative to the coupling part 38 and yet in each case a sealing connection can be obtained in that the O-ring 44 engages the cylindrical wall 42 of the jet breaker. The sealing is thus exclusively determined by the fit of the coupling part 38 within the cylindrical wall 42. Other dimensional tolerances are not critical in respect of the sealing connection between coupling part 28 and jet breaker 24. Consequently, also, the jet aerator housing 22 can be tightened against second conduit 18, so that the jet aerator housing 22 adjoins the second conduit 18 and thereby, in an aesthetic manner, forms a whole without seam with clearance between the jet aerator housing 22 and the second conduit 18. With the aid of a hose clip 48 which can be part of the coupling assembly 36 and which extends around the first conduit 16 adjacent the nipple 40, a stable watertight connection between the first conduit 16 and the coupling part 38 can be formed.

To provide an aesthetically fine tap outflow 10, it is advantageous when the tap T is provided with a jet aerator connecting element 50 which, for instance by a watertight soldered joint or threaded joint, is connected with an inwardly facing side of the second conduit 18. The jet aerator connecting element 50 shown is provided with outer thread 52 and has an outer diameter that is smaller than the outer diameter of the second conduit 18. The jet aerator housing 22 can then be provided with inner thread 54 which is configured for cooperation with the outer thread 52 of the jet aerator connecting element 50. For forming a watertight connection between the jet aerator housing 22 and the second conduit 18, a flexible sealing ring 51 may be provided. In the exemplary embodiment this sealing ring 51 is clamped between the jet breaker 24 on one side and the jet aerator connecting element 50 on the other side. From the viewpoint of aesthetics, it is particularly advantageous when the jet aerator housing 22 has an outer diameter that corresponds to the outer diameter of the second conduit 18, since the tap outflow 10 can then have a perfectly smooth outer profile.

Figure 3:
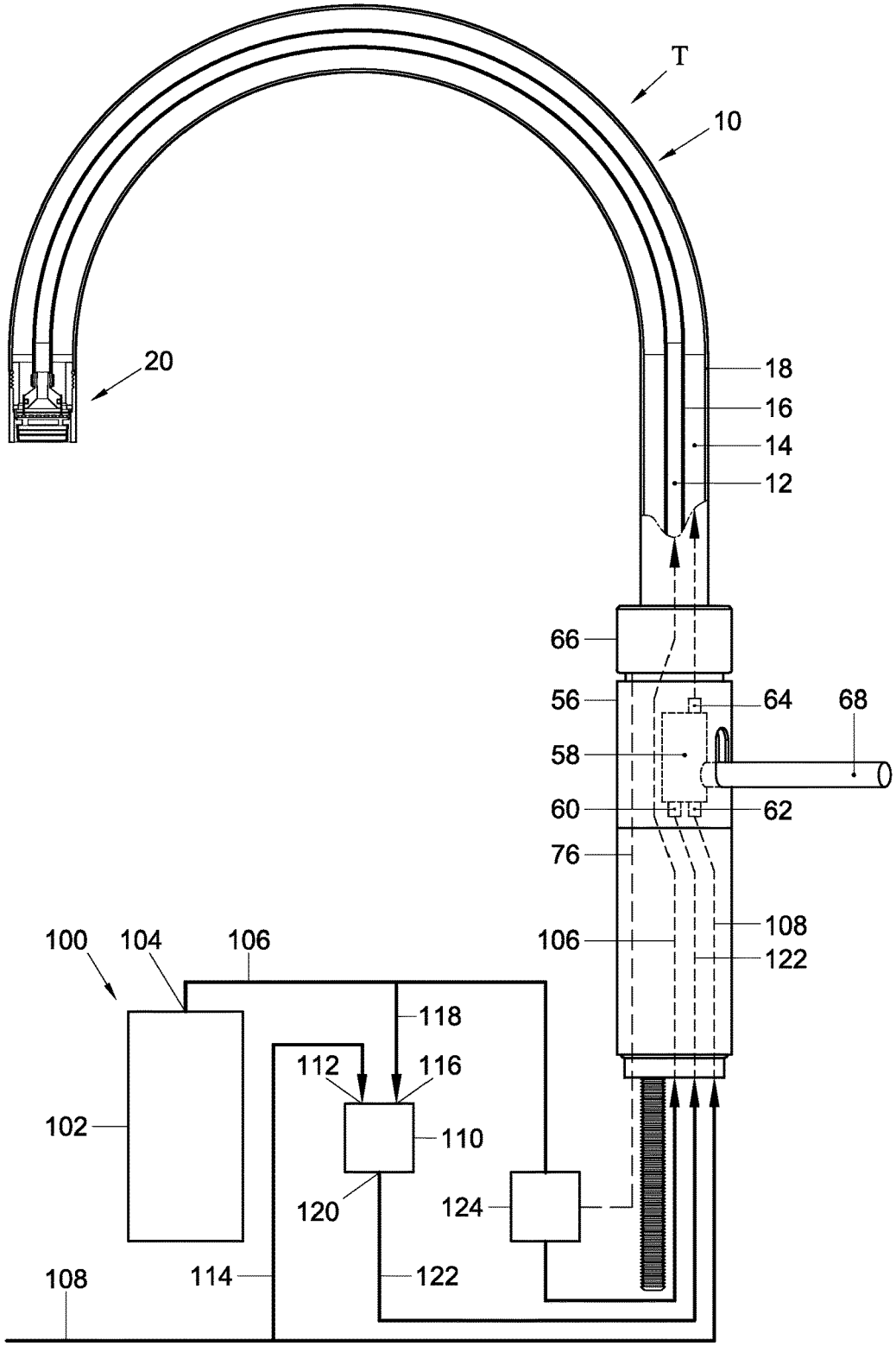
FIG. 3 shows schematically a second embodiment of an assembly of a boiling water device and an example of an embodiment of a tap.

In an embodiment, of which examples are shown in FIGS. 1 and 3, such a tap T may further be provided with an operating knob 66 which is connected via an electrical signal line 76 with an electrically operable liquid valve 124 in a first boiling water conduit 106 which is part of a fluid communication between a boiler tank 102 and one of the first and the second conduits 16, 18 of the tap 10. By operation of the operating knob 66 the electrically operable liquid valve 124 can be opened and closed.

FIG. 1 shows an example of an embodiment of an assembly of a tap T according to the invention and a boiling water device 100. The boiling water device 100 is provided with a boiler tank 102 with a boiling water outlet 104 which is in fluid communication with the interior of the boiler tank 102. A first boiling water conduit 106 is part of a fluid communication between the boiling water outlet 104 and one 12 of the first and the second channel 12, 14. Further, the assembly comprises a first cold water conduit 108 which is in fluid communication with the other 14 of the first channel and the second channel 12, 14. The tap T of the exemplary embodiment from FIG. 1 is provided with a simple cold water shutoff valve 70 with a cold water inlet 72 and a cold water outlet 74. The cold water shutoff valve 70 can be operated with handle 68. With such an assembly, via a single tap outflow 10 both boiling water and cold water can be dispensed, with both types of water flowing through the same jet aerator 20.

FIG. 3 shows an example of a further elaboration of the assembly, with the tap T being of the type according to claim 7. In that embodiment, the tap T may be provided with a tap body 56 with a mixing tap assembly 58 with a hot water inlet 60 for hot water having a temperature of, for instance, about 70° C. and with a cold water inlet 62 and with a mixed water outlet 64. The mixed water outlet 64 is in fluid communication with the second channel 14. With the aid of the mixing tap assembly 58, for example, hot water having a temperature of about 70° C. can be mixed with cold water. The mixer tap assembly 58 may, for instance, be operated with a handle 68. The mixing tap assembly 58 of the tap T is included in the above-mentioned fluid communication between the cold water conduit 108 and the other 14 of the first and the second channel 12, 14. The first cold water conduit 108 is connected to the cold water inlet 62 of the mixing tap assembly 58. The assembly further includes a mixing valve 110 which is arranged between the tap T and the boiler tank 102. The mixing valve 110, which can generally have a fixed, possibly settable mixing ratio, is provided with:

- a cold water inlet 112 which is connected to a second cold water conduit 114;
- a boiling water inlet 116 which is connected to a second boiling water conduit 118; and
- a hot water outlet 120 for hot water having a temperature of less than about 70° C.

The hot water inlet 120 is in fluid communication via a hot water conduit 122 with the hot water inlet 60 of the mixing tap assembly 58. The mixed water outlet 64 of the mixing tap assembly 58 is connected to the other one 14 of the first and the second channel 12, 14.

With such an assembly, boiling water having a temperature of at least 95° C. can be dispensed by operation of the operating knob 66. Further, via the same tap outflow 10 cold water can be dispensed and mixed water by operation of the handle 68. The temperature of the mixed water is temperature controllable between the temperature of the cold mains water coming from conduit 108 and the temperature of hot water coming from hot water conduit 122, which hot water generally has a temperature that is lower than 70° C.

In an embodiment, the boiling water device 100 may be provided with a tap T according to claim 8 and with an electrically operable liquid valve 124 which is included in the first boiling water conduit 106. The tap T is provided with the operating knob 66 which is in electrical communication via electrical signal line 76 with the electrically operable liquid valve 124, so that boiling water can be dispensed by operation of the operating knob 66.

The invention is not limited to the exemplary embodiments described. Various changes within the scope as defined by the claims are within possibility. The various embodiments described can be used independently of each other or in combination with each other. The reference numerals included in the claims do not limit the claims.

What is claimed is:

1. An assembly comprising:

a tap provided with a tap outflow having a first channel and a second channel, the tap outflow comprising:
- a first conduit which bounds the first channel;
- a second conduit which bounds the second channel; and
- a jet aerator provided with:
  - a jet aerator housing which forms a downstream end of tap outflow,
  - a jet breaker with a jet breaker wall having liquid passage openings, which jet breaker is included in the jet aerator housing,
  - at least one wire mesh layer which is included downstream of the jet breaker wall in the jet aerator housing,
  - an aeration chamber which is situated between the jet breaker and the at least one wire mesh layer,
  - an air supply of which an entrance opens into the environment and of which an exit opens into the aeration chamber, a coupling assembly which comprises a coupling part having therein an internal channel and to which the first conduit is connected, wherein a first part of the jet breaker wall bounds an outlet of the first conduit and a second part of the jet breaker wall bounds an outlet of the second conduit, wherein the first part is provided with first liquid passage openings which form a passage for liquid from the first channel, and wherein the second part is provided with second liquid passage openings which form a passage for liquid from the second channel, wherein both the first and the second liquid passage openings open into the aeration chamber, wherein the at least one wire mesh layer is configured such that, in use, both liquid coming from the first channel and liquid coming from the second channel passes through the at least one wire mesh layer, wherein the coupling assembly is situated upstream of the jet breaker wall and wherein the coupling part forms a liquid-tight connection between the first conduit and the jet breaker wall, wherein the coupling assembly is configured such that liquid from the first channel in use is guided exclusively via the internal channel in the coupling assembly to the first part of the jet breaker wall and thereupon is only dispensed via the first liquid passage openings, and such that liquid from the second channel is guided exclusively to the second part of the jet breaker wall and thereupon is only dispensed via the second liquid passage openings, wherein the assembly is further provided with:

a boiling water device provided with:

a boiler tank having a boiling water outlet which is in fluid communication with the interior of the boiler tank;

a first boiling water conduit which is part of a fluid communication between the boiling water outlet and a one of the first and the second channel, and a first cold water conduit which is in fluid communication with another one of the first and the second channel, wherein the tap is provided with a tap body having a mixing tap assembly with a hot water inlet and a cold water inlet and a mixed water outlet, wherein the mixed water outlet is in fluid communication with one of the first and the second conduit, wherein the mixing tap assembly is included in said fluid communication between the cold water conduit and the other one of the first and the second channel, wherein the first cold water conduit is connected to the cold water inlet of the mixing tap assembly, wherein the assembly is further provided with:

a mixing valve which is arranged between the tap and the boiler tank, wherein the mixing valve is provided with:

a cold water inlet which is connected to a second cold water conduit;

a boiling water inlet which is connected to a second boiling water conduit; and a hot water outlet for hot water having a temperature of less than 70 ° C., wherein the hot water outlet is in fluid communication via a hot water conduit with the hot water inlet of the mixing tap assembly, and wherein the mixed water outlet is connected to the other one of the first and the second channel.

2. An assembly comprising:

a tap provided with a tap outflow having a first channel and a second channel, the tap outflow comprising:

a first conduit which bounds the first channel;

a second conduit which bounds the second channel; and a jet aerator provided with:

a jet aerator housing which forms a downstream end of tap outflow, a jet breaker with a j et breaker wall having liquid passage openings, which jet breaker is included in the jet aerator housing, at least one wire mesh layer which is included downstream of the jet breaker wall in the jet aerator housing, an aeration chamber which is situated between the jet breaker and the at least one wire mesh layer, an air supply of which an entrance opens into the environment and of which an exit opens into the aeration chamber, a coupling assembly which comprises a coupling part having therein an internal channel and to which the first conduit is connected, wherein a first part of the jet breaker wall bounds an outlet of the first conduit and a second part of the jet breaker wall bounds an outlet of the second conduit, wherein the first part is provided with first liquid passage openings which form a passage for liquid from the first channel, and wherein the second part is provided with second liquid passage openings which form a passage for liquid from the second channel, wherein both the first and the second liquid passage openings open into the aeration chamber, wherein the at least one wire mesh layer being configured such that, in use, both liquid coming from the first channel and liquid coming from the second channel passes through the at least one wire mesh layer, wherein the coupling assembly is situated upstream of the jet breaker wall and wherein the coupling part forms a liquid-tight connection between the first conduit and the jet breaker wall, wherein the coupling assembly is configured such that liquid from the first channel in use is guided exclusively via the internal channel in the coupling assembly to the first part of the jet breaker wall and thereupon is only dispensed via the first liquid passage openings, and such that liquid from the second channel is guided exclusively to the second part of the jet breaker wall and thereupon is only dispensed via the second liquid passage openings, wherein the assembly is further provided with:

a boiling water device provided with:

a boiler tank having a boiling water outlet which is in fluid communication with the interior of the boiler tank;

a first boiling water conduit which is part of a fluid communication between the boiling water outlet and a one of the first and the second channel, and a first cold water conduit which is in fluid communication with another one of the first and the second channel, wherein the tap is provided with an operating knob which is in electrical communication with an electrically operable liquid valve in the first boiling water conduit which is part of a fluid communication between the boiler tank and the one of the first and the second conduits of the tap, the operating knob being operatively connected with the electrically operable liquid valve.

* * * * *